United States Patent [19]

Meyer

[11] 3,989,427

[45] Nov. 2, 1976

[54] ROTARY FLUID HANDLING DEVICE

[75] Inventor: C. Leonard Meyer, Montreal, Canada

[73] Assignee: The Raymond Lee Organization, Inc., a part interest

[22] Filed: June 21, 1974

[21] Appl. No.: 481,654

[52] U.S. Cl. ..... 418/150; 418/237; 29/156.4 WL

[51] Int. Cl.[2] ..... F01C 21/00

[58] Field of Search ..... 418/237, 150; 29/156.4 WL

[56] References Cited

UNITED STATES PATENTS

| | | | |
|---|---|---|---|
| 872,234 | 11/1907 | Henry | 418/237 |
| 1,716,901 | 6/1929 | Rochford | 418/237 |
| 3,387,565 | 6/1968 | Mezzetta | 418/237 |

FOREIGN PATENTS OR APPLICATIONS

| | | | |
|---|---|---|---|
| 857,652 | 12/1970 | Canada | 418/237 |
| 440,306 | 7/1912 | France | 418/237 |
| 104,737 | 3/1917 | United Kingdom | 418/237 |

*Primary Examiner*—C. J. Husar

[57] ABSTRACT

A rotary device of the type having an oblong chamber and a rotating rotor therein. Arcuate vanes are slidably mounted in the rotor so as to rotate therewith and concurrently slide relative thereto such that the ends of the vanes constantly engage the walls of the oblong chamber. The chamber walls, viewed axially in cross-section, comprise a pair of straight sides and a pair of curved ends. The curvature of these ends is derived mathematically from a square, the sides of which square form the said straight sides of the chamber walls.

11 Claims, 12 Drawing Figures

ROTARY FLUID HANDLING DEVICE

BACKGROUND OF THE INVENTION

This invention relates to a rotary fluid handling device adapted for use as either a pump or a motor, and in particular it relates to a rotary fluid handling device of the type having an oblong chamber, a rotor therein, and vanes slidably mounted in the rotor and engaging the walls of the chamber to form expandable chambers.

Rotary fluid handling devices of the present type are known, as shown for example in U.S. Pat. Nos. 2,470,987 and 3,387,565. However, the efficiency of this type of device depends in large part on the smooth cooperations between the vanes and the chamber walls, and to this end, there exists a need for new and improved designs in vanes and/or chamber walls to improve the cooperation therebetween.

SUMMARY OF THE INVENTION

Thus, it is a purpose of the present invention to provide a new and improved rotary fluid handling device of the present type wherein cooperation between the vanes and the chamber walls is significantly improved, thereby improving the overall operating efficiency of the device.

This purpose is achieved in accordance with the present invention by providing a chamber having a new and improved profile including a pair of straight sides and a pair of curved ends, the curvatures of which are derived from a square, the sides of which form the said straight sides. The purpose of the invention is also achieved by providing new and improved features associated with the rotating rotor and the vanes slidable therein, and also a method for making an oblong chamber having the new and improved profile.

The rotary device of the present invention is adapted for use as a fluid motor such as an internal combustion engine or a rotary pump.

In one embodiment, the rotary device comprises a cylindrical rotor with sliding arcuate vanes sliding through slots within the cylindrical rotor. In the other embodiment, the vanes slide along arcuate outer surfaces of the rotor and are slidable in grooves formed in end plates which rotate with the rotor. In either case, the vanes will include seals at the outer ends thereof which engage the walls of the chamber together with spring means urging these seals outwardly relative to the vanes against the walls of the chamber. In one arrangement, the seals project into slots in the ends of the arcuate vanes and springs are located in these slots so as to urge the end seals outwardly. In another arrangement, sleeves having the seals at the outer ends thereof fit over the vanes surrounding the same and springs are provided within the sleeves acting against the vanes themselves. In any of these vane embodiments, the two end seals associated with each vane are movable by their respective springs independently of each other so that the overall length of each vane from end seal to end seal can change as the vane rotates about the chamber whereby it is assured that both ends of the vane are constantly in engagement with the walls of the chamber. Another advantage of separate end seals is that centrifugal force will assist in maintaining these seals against the walls of the chamber as the speed of the device increases.

In one embodiment, two arcuate vanes are provided, thus creating four end seals and hence four working chambers. Alternatively, three vanes can be provided 120° apart, thereby providing six end seals and hence six different working chambers.

When the device is used as an internal combustion engine, a spark plug will be provided along one of the straight sides while the exhaust and intake ports will be provided along the other straight side. In this arrangement, four working chambers and hence four power pulses are provided for each 360° of rotation with the embodiment having two arcuate sliding vanes, and of course six working chambers and hence six power pulses are provided for each 360° of rotation with the embodiment having three arcuate sliding vanes.

When the device is used as a pump, a set of exhaust and intake ports will be provided along each of the straight sides whereby there will be eight pumping strokes and twelve pumping strokes with the embodiments having two and three vanes, respectively, for each 360° of rotation.

The sliding arcuate vanes should be made as light as possible so as to eliminate some of the force caused by their characteristic changing state of motion, but strong enough to withstand the power pulses that will be exerted upon them. The unique design features of the present invention afford high intake volume and practical compression ratios are easily achieved. For example, each pump as described above has a high volume and a double action, i.e., it acts like two pumps within one casing. Thus, the present device can deliver a large output at a relatively slow speed, although of course even a larger output will be achieved as the speed increases. Moreover, the simplicity of the present design should make it reasonably economical to produce.

Thus, it is an object of this invention to provide a new and improved rotary device of the type described.

It is another object of this invention to provide a new and improved rotary device of the type described adaptable for use as either a pump or a motor wherein smoother cooperation is achieved between the arcuate sliding vanes and the chamber walls.

It is another object of this invention to provide, in a rotary device of the type described, an oblong chamber, the walls of which include a pair of straight sides which merge smoothly with a pair of curved ends, the curved ends being derived from a square, the sides of which form the said straight sides.

Another object of the present invention is to produce a pump or motor which will excel in many fields of operation such as automobiles, motorcycles, snowmobiles, boats, ships, aircraft and the like, which rotary devices are made of lightweight materials for pumping at low pressure or more heavily constructed for pumping at higher pressures or when operated as an internal combustion engine, but still compact and lightweight in comparison with other pumps and motors known today.

Other objects and advantages of the present invention will become apparent from the detailed description to follow, together with the accompanying drawings.

BRIEF DESCRIPTION OF THE DRAWINGS

There follows a detailed description of preferred embodiments of the invention to be read together with the accompanying drawings which are provided for purposes of illustration.

DETAILED DESCRIPTION OF THE PREFERRED EMBODIMENT

Figure 1:
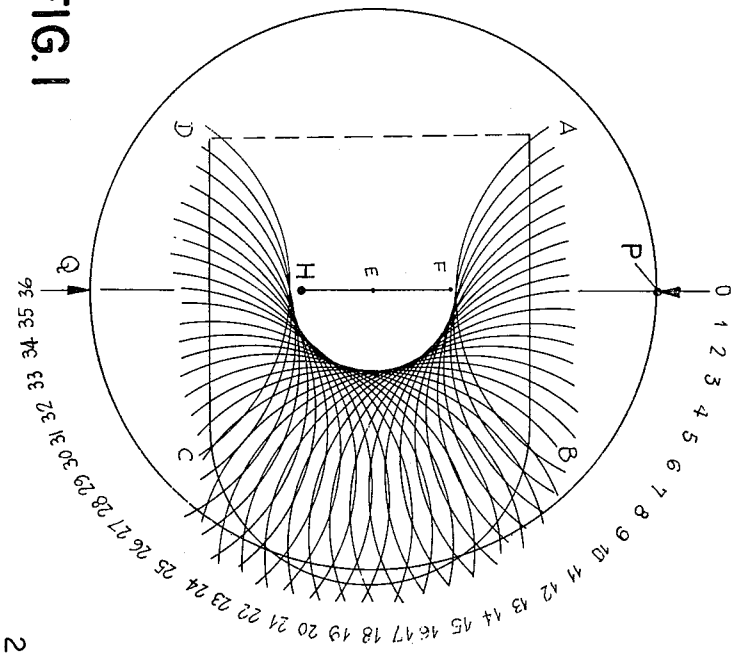
FIG. 1 is a diagrammatic view illustrating the procedure for deriving the shape of the oblong working chamber of chamber and of the length and degree of curvature of the arcuate vanes the rotary device according to the present invention.

Referring now to the drawings, like elements represent like numerals throughout the several views.

Referring to FIG. 1, this figure illustrates schematically the procedure for forming the shape of the oblong chamber. Starting with a square of any given size as indicated by points A, B, C, D of FIG. 1, find the center point E and draw a line therethrough perpendicular to sides AB and CD. Along this line find the point F midway between E and line AB and from point F, draw lines from F to A and F to B. Draw the right bisectors of these lines and produce them to intersect, thus finding the point P which is the center of an arc through points A, F, and B. With E as the center and EP as the radius, draw a circle completely around the square. On one side of this circle mark off an equal number of points, for example, 37 points are shown in the drawings, but any number of points may be used, the specific number depending on the degree of precision required. With each of the points PQ as a center, describe an arc with a radius equal to PF. The arc from point P will pass through points A, F and B and the arc from point Q will pass through points C and H and D. However, all of the arcs from the intermediate points 1–35 will cross either the line AB or the line CD and then also the line BC. Where the arcs cross the line BC, continue the arcs outwardly slightly beyond the circumference of the circle described about center E. Next, across each one of these arcs, mark a distance equal to AB starting from the point where the given arc crosses line AB or line CD as the case may be and ending at a point to be marked and indicated as a reference point on that arc. When all of the reference points have been so marked, connect the reference points to form smooth curves between the points B and C. Actually, two separate curves will be formed. One curve will be innermost closest to point C and then outermost closest to point B while the other curve will be innermost closest to point B and outermost closest to point C, the two curves being generally coincident midway between points B and C where they cross. The curvature of the chamber is then defined by taking the outermost portions of these two curves and the coincident portions thereof. The same procedure is then followed for forming the curvature of the opposite end curve connecting points A and D on the opposite side of line PQ. The lines AB and CD will then of course form the straight sides of the oblong chamber. From the procedure in FIG. 1, it will also be noted that arc AB forms the center line for the specific curvature of the arcuate vanes and line AB the specific length thereof.

Figure 3:
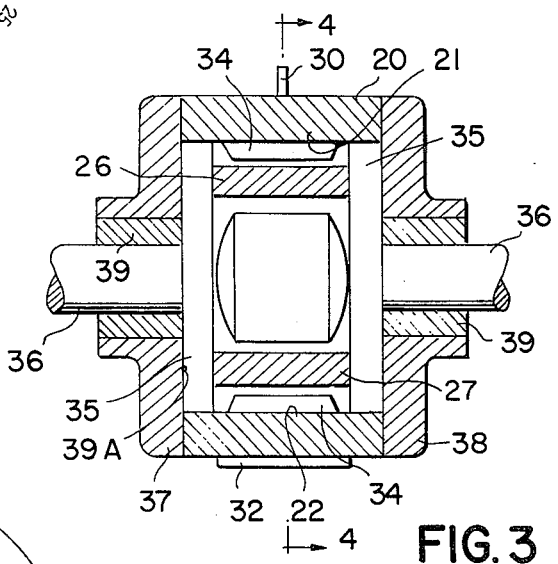
FIG. 3 is a cutaway view taken along line 3—3 of FIG. 2, showing the housing in cross section and the rotor assembly intact, but without the arcuate vanes.
Figure 2:
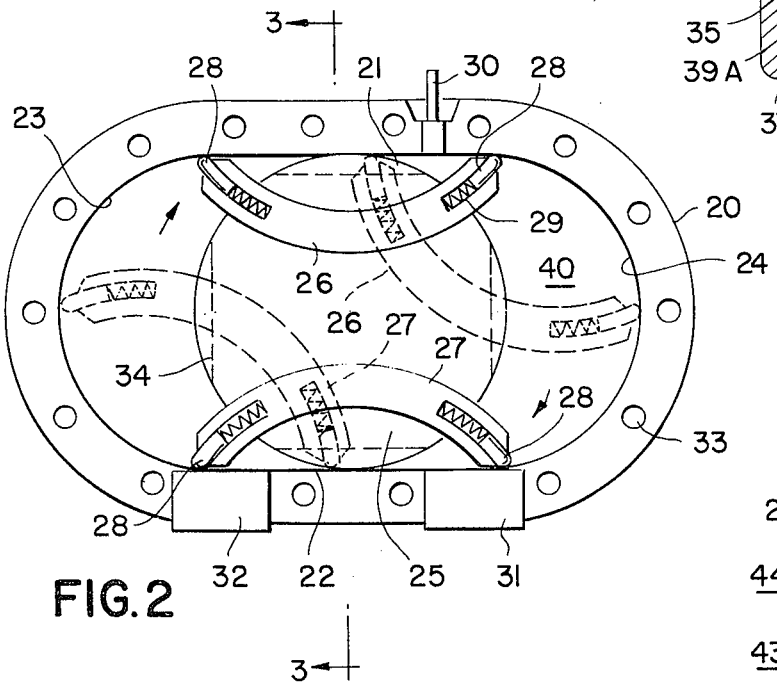
FIG. 2 is a cross-sectional view of a first embodiment of a rotary device constructed in accordance with the present invention, and taken along line 4—4 of FIG. 3.

FIGS. 2 and 3 illustrate one embodiment of the invention adapted for use as an internal combustion engine. The walls of the central part of the housing 20 comprise upper and lower straight sides 21 and 22 and curved end portions 23 and 24 defining the oblong chamber. Within this chamber there is provided a rotor 25 which rotates about its axis and includes arcuate grooves therein for slidably receiving arcuate vanes 26 and 27 having a radius corresponding to the arc radius from point P passing through points A, F and B, as shown in FIG. 1. Each of these vanes include seals 28 at the ends thereof urged into engagement with the walls of the oblong chamber by springs 29. The seals 28 form between them four separate working areas. At appropriate locations in the housing there is provided a spark plug 30, and exhaust port 31, and an intake port 32. Also shown in FIG. 2 are a plurality of bolt holes 33 passing through the casing 20, through which bolt holes bolts are passed for holding the rotary device together.

While the rotor 25 is normally a simple cylinder (except for the grooves with the vanes therein) in the present embodiment, the rotor 25 is provided with a pocket 34 in each of the four working areas. This provides a means for regulating the compression ratios. By making the pocket shallower the compression ratio will be increased. Deepening the pocket will have the opposite effect.

Referring to FIG. 3, the rotor 25 is affixed to end plates 35 which are in turn fixed to a shaft 36 whereby upon rotation of the shaft 36 the end plates 35 and the rotor 25 rotate as a unit. The overall device further includes a pair of housing end plates 37 and 38 and bearings 39 for the shaft 36. The housing end plates 37 and 38 would include holes aligned with the holes 33 in the central housing part 20 whereby bolts can be passed completely through the aligned holes in elements 37, 20 and 38 for holding the housing together.

Referring again to FIG. 2, the device shown in FIGS. 2 and 3 would operate as follows. The fuel-air mixture would be drawn through the intake port 32 into the working area between end seals 28 as the latter moved about the axis of the rotor, this working area thereby enlarging as shown in dotted lines in FIG. 2. As the seal 28 passes across the intake port 32, the space between seals 28 would commence compressing the gas therein until the seals 28 shown in the dotted lines assume the position of the seals 28 in the solid lines. Combustion occurs in the area 40, urging the rotor in the clockwise direction. It will of course be understood that this cycle is repeated for each of the four working areas, whereby four power pulses are provided for each 360° revolution of the rotor.

Figure 4:
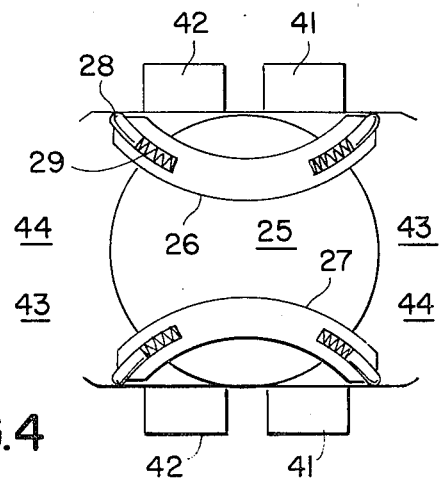
FIG. 4 is a schematic view of a portion of a rotary device similar to FIG. 1 and showing the slight modifications required to adapt the present invention as a pump.

FIG. 4 illustrates how the embodiment of FIGS. 2 and 3 would be constructed for use as a pump. The walls of the chamber would be the same as shown in FIG. 2.

The rotor 25 would not include pockets 34 as shown in FIG. 2 since seals must be formed where the rotor engages the straight wall portions 21 and 22. In this case, at both the top and the bottom there are provided inlet ports 41 and exhaust ports 42. The areas indicated as 43 would represent the general areas where the four working chambers would be increasing in size while drawing fluid into the device through inlet ports 41. The areas indicated as 44 would then represent the pressure areas where the working chambers would be decreasing in size, forcing the fluid out through exhaust ports 42. In the case of a pump, of course, each of the four working areas completes its cycle through 180° of revolution of the rotor so that eight complete pumping pulses are carried out through one 360° rotation of the rotor 25.

Figure 5:
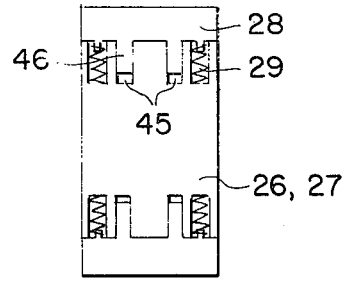
FIG. 5 shows an element of FIG. 4.

FIG. 5 illustrates the vanes 26 and 27 in greater detail showing slots 45 therein for receiving guide pins 46 (in addition to those slots receiving the springs 29) thus further guiding the movement of the end seals 28. This construction can of course be applied to the embodiment of FIGS. 2 and 3 as well as the embodiment of FIG. 4.

Figure 6:
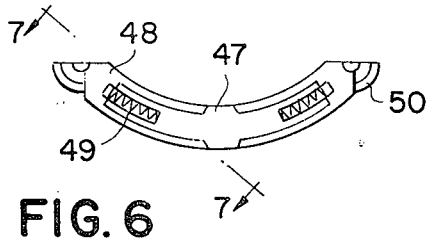
FIG. 6 shows a modified vane construction.
Figure 7:
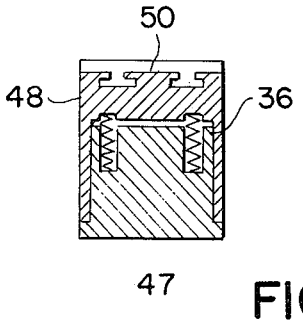
FIG. 7 is a partial cross-sectional view taken along line 7—7 of FIG. 6.

FIGS. 6 and 7 illustrate a modified form of the arcuate vane. In this case the vane 47 includes sleeves 48 at each end thereof urged outwardly by springs 49. End seals 50 are provided at the outer ends of the sleeves 48, these seals being connected to the sleeves by suitable arcuate T connections.

Figure 8:
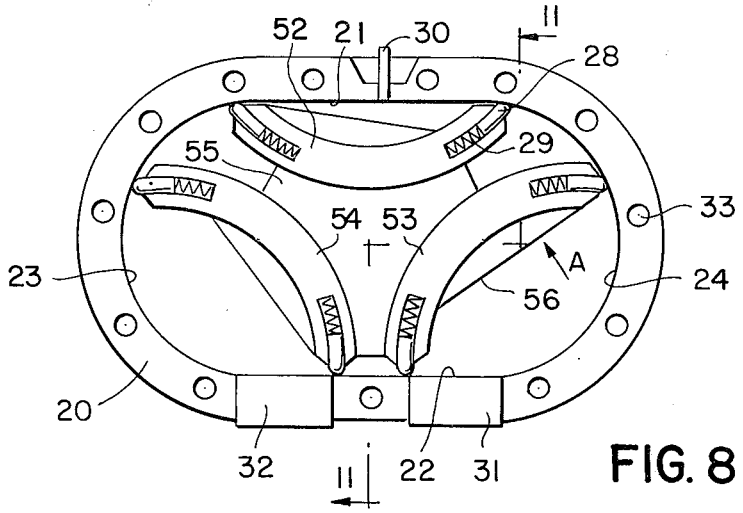
FIG. 8 is a cross-sectional view similar to FIG. 2 but showing the other embodiment of the invention.

FIGS. 8, 9, 10, 11 and 12 illustrate the other embodiment of the present invention, adopted for use as an internal combustion engine. The walls of the central part of the housing comprise upper and lower straight sides 21 and 22 and curved end portions 23 and 24 defining the oblong chamber as in FIG. 1. Within this chamber there is provided a new type rotor 55 which rotates about its axis and includes three outer arcuate surfaces 120° apart, for slidably receiving three arcuate vanes 52, 53 and 54 having a radius corresponding to the arc radius from point P passing through points A, F, and B as shown in FIG. 1. Each of these vanes includes seals 28 at the ends thereof, urged into engagement with the walls of the oblong chamber by springs 29. The seals form between them six separate working areas. At appropriate locations in the housing there are provided a sparkplug 30 and exhaust port 31 and intake port 32. Also shown in FIG. 8 are a plurality of bolt holes 33 passing through the casing 20 through which bolt holes bolts are passed for holding the rotary device together.

Figure 10:
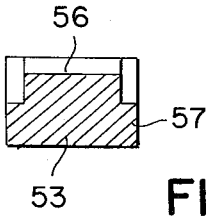
FIG. 10 is a cross-sectional view taken along line 10—10 of FIG. 9.
Figure 11:
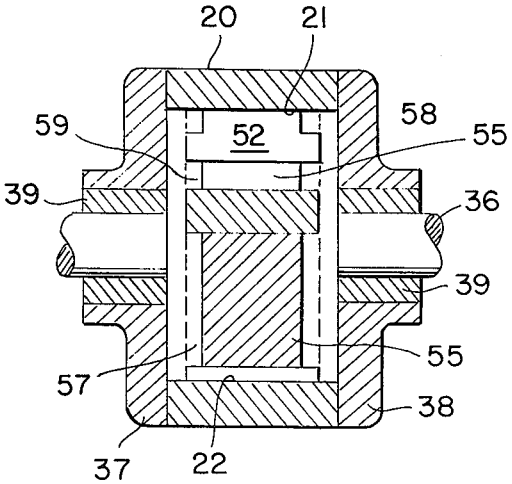
FIG. 11 is a cross-sectional view taken along line 11—11 of FIG. 8 showing the rotor assembly intact, minus the arcuate vanes.
Figure 12:
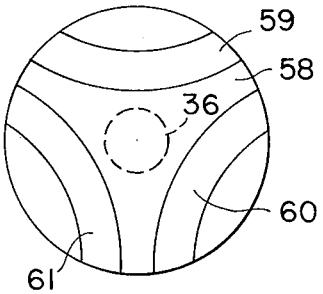
FIG. 12 illustrates an end plate of the embodiment of FIG. 8 and 11.

In FIGS. 8 and 11, the rotor 55 is essentially triangular, having three outer arcuate surfaces mating with the inwardly facing convex surfaces of vanes 52, 53 and 54. These vanes, which are further illustrated in FIGS. 9 and 10, include filled-in areas 56 and guide portions 57. In this embodiment, the end plates 58 which are connected to the rotor 55 to rotate therewith by means of their fixed connections to the shaft 36, include grooves 59, 60 and 61 (see FIG. 12) adapted to receive therein the guide portions 57 of vanes 52, 53 and 54, respectively. Thus, as the rotor 55 is rotated about its axis, the arcuate vanes slide along the surfaces of rotor 55 with which they mate, at the same time guided arcuately by their engagement with the corresponding grooves in end plates 58.

The main difference in the embodiment shown in FIG. 8 to that shown in FIG. 2, aside from the addition of a third vane, is the means for mounting the vanes on the rotor although it will be understood that this mounting arrangement could be applied to the embodiment in FIG. 2. In other respects the embodiment of FIG. 8 is similar to the embodiment of FIG. 2, i.e. it includes a specific oblong chamber, the walls 21, 22, 23, and 24, the vanes 52, 53, and 54 with a specific degree of curvature all constructed in accordance with the principles illustrated in FIG. 1.

Figure 9:
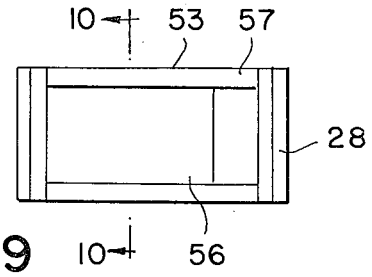
FIG. 9 illustrates an element of FIG. 8, taken in the direction of the arrow A of FIG. 8.

Referring to FIGS. 8, 9 and 10, each arcuate vane 52, 53 and 54, and its filled-in portion 56 and guide portion 57 is made of one piece, providing strength and rigidity. Further, the vanes slide on the rotor rather than through it so that the working pressures are distributed evenly along the entire outer surfaces of the vanes helping to hold them in position on the rotor and facilitating rotation during the power cycles of the device. Also, since the vanes have only one arcuately curved side in slidable contact with the rotor, this will reduce friction, contributing to a more smoothly operating rotor assembly.

The compression ratio for the embodiment of FIG. 2 would be 10:1 and the compression ratio for the embodiment of FIG. 8 would be 9:1. However, these ratios can of course be changed. For example, in the embodiment of FIG. 2, the size of the pockets 34 can be changed to change the compression ratio. In the embodiment of FIG. 8, the size of the rotor 55 and the size of the filled-in areas 56 can be varied to change the compression ratio in that embodiment.

It will be understood that when operating as a combustion engine, any of the illustrated embodiments could be operated as a diesel engine as well as a spark-ignited internal combustion engine. In the embodiment of FIGS. 8 and 11, the internal combustion engine has six power strokes for each 360° of rotation and the pump would have 12 pumping strokes for each 360° rotation.

Although the invention has been described in considerable detail with respect to preferred embodiments thereof, it will be apparent that the invention is capable of numerous modifications and variations apparent to those skilled in the art without departing from the spirit and scope of the invention as defined in the claims.

I claim:

1. A rotary fluid handling device comprising a main chamber derived from a square and a rotating element with grooved end plates within the chamber which includes vanes of specific curvature and length and cooperating therewith to define working chambers within the chamber, the walls defining the chamber, when viewed in cross-section in the axial direction, comprising a pair of parallel sides derived from the sides of a square and a pair of inwardly concave curved ends interconnecting said straight sides, said curved ends having a shape defined as follows:

a. starting with a square wherein A, B, C and D represent the four corners thereof with one straight side of the chamber lying along AB and the other said straight side of the chamber lying along CD, draw a reference line through the center E of the square intersecting line AB at right angles thereto, b. from a point F on the reference line midway between E and line AB draw lines to corner A and to corner B and find the point which is at the center of a circular arc which includes thereon points A, F, and B, c. with point E as a center and the distance between E and P as a radius, define a circle about the square, d. mark off a plurality of equally spaced points about half of the circle starting from point P and ending at point Q which is diametrically opposed to point P which half circle encompasses side BC of the square, e. with each of the said center points as a center, describe a circular arc intersecting the square at two points, wherein all arcs other than those from center points P and Q intersect either line AB or CD as one of said points and then BC as the other of said points.

f. on each of said arcs, mark off a straight line distance equal to a side of the square from the point where that arc intersects either line AB or CD and ending at a reference point on that arc beyond the side BC, g. connect the reference points along curves which are concave towards point E, there being first and second generally coextensive curves wherein along a portion including at least one point the two curves are coincident, along another portion the first curve is outward of the second curve and along another portion the second curve is outward of the first portion, and wherein the coincident portion and the outermost portions of the first and second curves define one of said curved ends of the chamber, h. repeat steps (d) to (g) on the opposite sides of line PQ to define the other curved end of the chamber interconnecting points A and D.

2. A device according to claim 1 wherein the element is a rotor with grooved end plates within the casing, and said vanes are two sleeved curved vanes mounted on the rotor to move therewith about the axis of the rotor and slidable within the rotor to maintain the ends thereof in contact with the chamber wall.

3. A device according to claim 2, each said vane including a sleeve surrounding it at each end thereof and a seal on the end of each sleeve.

4. A device according to claim 1, said element being generally cylindrical and including arcuate slots therein, the sleeved vanes being slidably mounted in said slots and held in position by said curved end plates.

5. A device according to claim 1, wherein said end plates are rotatable with the element and are located at the axial ends of the chamber, said plates having opposed arcuate grooves, there being two vanes, each vane including a guide portion extending into a corresponding groove to maintain the vanes in sliding contact on the element.

6. A device according to claim 1, which includes these curved vanes having outwardly concave portions partially filled in and slidably mounted on the element and held therein by said plates.

7. A device according to claim 1 wherein there are two vanes disposed 180° apart and concave away from the element axis, said vanes being sleeved, the volume between the four ends of the two vanes defining four working chambers movable about the chamber.

8. A device according to claim 1 wherein there are three vanes disposed 120° apart and concave away from the element axis.

9. A device according to claim 1 which includes vanes which are sleeved and are disposed symmetrically about the element.

10. A device according to claim 6 wherein the element is generally cylindrical and wherein each vane has a guide portion, said portion slidably mounting said vanes on said element.

11. In the production of a rotary fluid handling device of the type having a main chamber and a rotating element within the chamber which includes vane means rotating therein and cooperating therewith to define working chambers within the chamber, a method of forming the walls of defining the chamber, viewed in cross-section in the axial direction, comprising forming a pair of straight parallel sides and a pair of inwardly concave curved ends interconnecting said straight sides, said curved ends being formed by the following steps:

a starting with a square wherein A, B, C and D represent four corners thereof with one straight side of the oblong chamber lying along AB and the other said straight side of the chamber lying along CD, draw a reference line through the center E of the square intersecting line AB at right angles thereto.

b. from a point F on the reference line midway between E and line AB draw lines to corner A and to corner B and find the point P which is at the center of a circular arc which includes thereon points A, F and B, c. with point E as a center and the distance between E and P as a radius, define a circle about the square, d. mark off a plurality of equally spaced points about half of the circle starting from point P and ending at point Q which is diametrically opposed to point P, which half circle encompasses side BC of the square, c. with each of said center points as a center, describe a circular arc intersecting the square at two points, wherein all arcs other than those from center points P and Q intersect either line AB or CD as one of said points and then BC as the other of said points, f. on each of said arcs, mark off a straight line distance equal to a side of the square from the point where that art intersects either line AB or CD and ending at a reference on that arc beyond the side BC, g. connect the reference points along curves which are concave towards point E, there being first and second generally coextensive curves wherein along a portion including at least one point the two curves are coincident, along another portion the first curve is outward of the second curve and along another portion the second curve is outward of the first portion, and wherein the coincident portion and the outermost portions of the first and second curves define one of said curved ends of the oblong chamber, h. repeat steps (d) to (g) on the opposite sides of line PQ to define the other curved end of the oblong chamber interconnecting points A and D.

* * * * *